United States Patent [19]

Voisin

[11] Patent Number: 4,610,379

[45] Date of Patent: Sep. 9, 1986

[54] DEVICE FOR HOLDING A TEXTILE ARTICLE IN THE COURSE OF TREATMENT

[75] Inventor: Eugéne Voisin, Bouilly, France

[73] Assignee: Institut Textile de France, France

[21] Appl. No.: 590,845

[22] Filed: Mar. 19, 1984

[30] Foreign Application Priority Data

Mar. 22, 1983 [FR] France ..... 83 04677

[51] Int. Cl.[4] ..... B65H 7/20; D06B 3/26

[52] U.S. Cl. ..... 226/42; 68/177; 226/118; 226/171

[58] Field of Search ..... 226/42, 118, 119, 171; 68/5 C, 5 D, 5 E, 177, 178, 158; 34/155, 24; 28/251, 256; 8/152

[56] References Cited

U.S. PATENT DOCUMENTS

| | | | |
|---|---|---|---|
| 2,826,479 | 3/1958 | Cole | 226/118 X |
| 3,059,460 | 10/1962 | Kusters | 68/177 X |
| 3,284,868 | 11/1966 | Langway et al. | 28/251 |
| 3,322,363 | 5/1967 | Davidson et al. | 242/58.1 |
| 3,332,595 | 7/1967 | Wetzler | 226/119 |
| 3,353,242 | 11/1967 | Schrader | 28/251 |
| 4,078,403 | 3/1978 | Kutz et al. | 68/158 X |
| 4,196,832 | 4/1980 | Kusters et al. | 68/178 X |

FOREIGN PATENT DOCUMENTS

| | | | |
|---|---|---|---|
| 2207964 | 9/1973 | Fed. Rep. of Germany | 68/177 |
| 2910485 | 9/1980 | Fed. Rep. of Germany | 68/177 |
| 1352521 | 1/1964 | France | 28/251 |
| 89721 | 6/1967 | France . | |
| 1585151 | 1/1970 | France | 68/178 |
| 141761 | 5/1980 | German Democratic Rep. | 28/251 |

*Primary Examiner*—Philip R. Coe

*Attorney, Agent, or Firm*—Ostrolenk, Faber, Gerb & Soffen

[57] ABSTRACT

The present invention relates to the treatments, particularly in a gaseous medium, of textile articles accumulated in folds and moving under the effect of their own weight along an inclined surface. According to the process of the invention, the displacement of the article is accompanied by a mobile surface in contact with the upper part of the folds formed by the article; this mobile surface is driven so that it moves at a speed approximately equal to that of the article when said article slides normally along the inclined surface. The mobile surface consits of an endless belt whose outer surface, in contact with the upper face of the folds formed by the article, is at a constant distance from the inclined wall.

9 Claims, 5 Drawing Figures

DEVICE FOR HOLDING A TEXTILE ARTICLE IN THE COURSE OF TREATMENT

BACKGROUND OF THE INVENTION

The present invention relates to the treatments of textile articles particularly in a gaseous atmosphere and in particular when such treatments are made on an article in loop form and when the latter is piled in folds and slides under the effect of its own weight over a sliding surface. It is particularly useful in connection with relaxation of knitted articles, for example after dyeing.

Treatments of textile articles by liquids where the textile article in loop form is deposited in folds and moves under the effect of its own weight over a sliding surface, while it is immersed in a bath of dye or washing bath, are known. In such a liquid medium, the regular displacement of the article, without jerks, is facilitated by the damping action of the liquid. European Patent Application No. 82.402013.5 describes a process and a device for relaxing articles of knitted fabric, which process employs a sliding surface on which the knitted article is deposited in folds and slides in a gaseous medium, (air or vapour). In such a medium, the slide of the article over the surface may be disturbed by jerks, as a function of the weight of the article, the uniformity of the folds, and of the state of dryness of the article during the entire treatment. Under these conditions, the speed of displacement of the article must be reduced in order to obtain appropriate treatment.

BRIEF DESCRIPTION OF THE INVENTION

It is an object of the present invention to provide a device for ensuring, during treatment, the regular advance of a textile article piled in folds and moving under the effect of its own weight along an inclined surface. This device is characterized by an endless belt of which a portion of the outer surface is in contact with the upper part of the folds formed by the article, and moves in the same direction as the displacement of the article. The function of this belt is to accompany the article in its displacement. Therefore, it is particularly advantageous if the linear speed of the belt is never less than the nominal speed of the article; in fact, in the event the linear speed of the article decreases and becomes less than the nominal speed, the belt moves the article along due to the forces of friction between the outer surface of the belt and the upper part of the folds.

In a particular embodiment, that roller among those which support the endless belt, which is the driving roller, possesses a shaft equipped with a free wheel, and the linear speed given by the rotation of this driving shaft is slightly less than the nominal speed. Consequently, when the article slides over the inclined surface at the normal speed, the displacement of the article moves the belt at the nominal speed, and the free wheel mounted on the shaft of the driving roller rotates at this nominal speed. However, whenever the article slows down, the speed thereof drops to below the nominal speed until it reaches the linear speed determined by the rotation of the driving shaft, and the article is therefor moved along by the belt whose displacement is in that case ensured by the driving roller.

In another particular embodiment, the belt is also taken along by the article itself, but the driving roller is connected to a variable-speed motor and comprises a displacement sensor, arranged so that, when the speed of displacement of the belt is substantially less than nominal speed, the sensor controls a momentary acceleration of the speed of rotation of the driving roller, during a sufficient period of time for the speed of the article to be re-established at the nominal speed. In this particular case, abnormal accumulation of folds at a given point of the inclined surface is impeded by the sudden drive of the belt.

For the belt to perform its role of accompaniment, it is indispensable that the contact between the outer surface of the belt and the upper part of the folds formed by the article be sufficient for the forces of friction to be able in particular to produce the effects described hereinbefore, but this contact must not be too great and there must be no crushing of the folds, which would risk creating irreversible damage on the textile article. Nevertheless, it must be possible to carry out the same treatment on any article whatever its weight and density, and therefore whatever the height of the folds formed when the article is deposited on the inclined surface. To solve this problem, an endless belt has been proposed, characterized in that each of the shafts of the rollers which supports it is mounted on a lever arm comprising a counterweight, with the result that the belt can absorb minor variations in thickness of the folds formed by the article during treatment, without crushing, and the counterweight is provided with an adjusting device for varying the spacing between the belt and the sliding surface, and thus taking into account the variations in thickness of the folds from one article to another. It is further preferable if all the points of the portion of belt which are in contact with the upper part of the folds formed by the article are at an approximately constant distance from the sliding surface.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
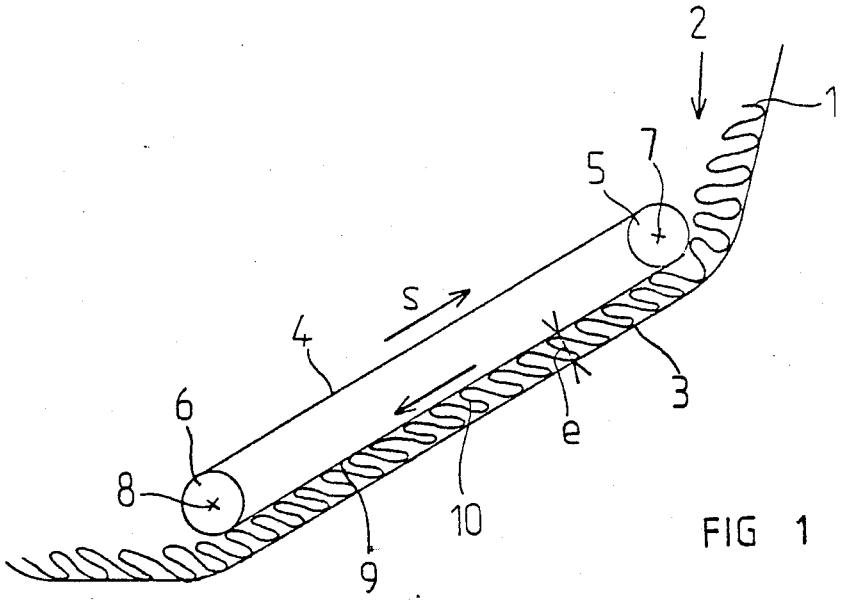
FIG. 1 schematically shows an endless belt especially designed to carry out the process according to the invention.
Figure 2A:
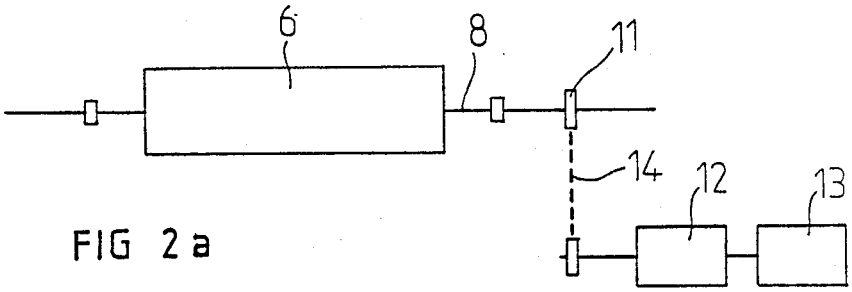
FIGS. 2*a* and 2*b* schematically show the driving roller of the endless belt and its drive system in two particular embodiments.

Referring now to the drawings, the textile article 1 in the course of treatment in a gaseous atmosphere, for example in the course of drying in hot air or of relaxation in a steam atmosphere, is deposited in folds 2 on an inclined surface 3 constituted by a metal part along which the folded article slides under the effect of its own weight. The endless belt 4 is maintained stretched between two rollers 5 and 6 whose axes 7 and 8 are parallel to each other and perpendicular to the direction of displacement of the article 1 along the surface 3. The roller 6 is the driving roller and drives the belt 4 in a movement in the direction of arrow S, with the result that the portion of belt whose outer surface 9 is in contact with the upper part 10 of the folds 2 of the article 1 moves in the same direction as the article sliding along the surface 3 under the effect of its own weight. The spacing e between the outer surface of the belt 9 at the point where it is in contact with the article 1 and the inclined wall 3 is adjusted so that the folds formed by the article are not subjected to crushing, although forces of friction are created between the outer surface of the belt and the article itself. In the case illustrated in FIG. 2*a*, the shaft 8 of the driving roller 6 is equipped with a free wheel 11 which is connected to a variable-speed motor assembly 12–13 by a chain 14. The belt-roller assembly has a very low inertia. For the same inclined wall 3 and the same mode of depositing in folds, a given article will have a speed of displacement by sliding which will be a function of various parameters, particularly the weight per square meter and the suface state of the article. When sliding is effected normally the article moves at a given speed, which is designated nominal speed. The rotation of the motor 12 is adjusted with the aid of the variable-speed unit 13 so that it drives the belt 4 at a linear speed slightly less than said nominal speed. In this way, when the article 1 slides normally along the wall 3, the forces of friction created between the article 1 and the belt 4 drive the belt 4 at said nominal speed, the shaft 8 consequently rotates more quickly than the speed procured by the motor 12 (this being being permitted by the free wheel 11). On the other hand, if owing to non-uniform deposit of the article 1, or for any other reason, the article 1 accumulates along the wall 3 and slides at a speed which is less than the nominal speed, the motor 12 drives the shaft 8, and therefore the belt 3 positively at the predetermined speed, which is slightly less than the nominal speed. Due to the forces of friction, the article is then driven by the displacement of the belt 3. Under result that the jerking is toned down and the slide of the article becomes normal again.

Figure 2B:
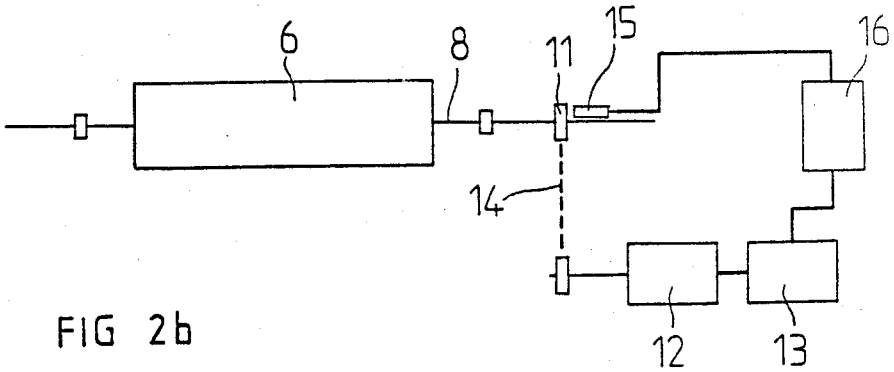

According to another embodiment, illustrated in FIG. 2*b*, a displacement sensor 15, connected to the variable-speed unit 13, tanks to an appropriate treatment cell 16, controls the rotation of the motor 12 solely when the linear speed of the belt 6 drops to below the nominal speed. In this way, when the article 1 slides normally, the belt is driven as in the first embodiment, but when the slide is disturbed and the speed of the article attains a predetermined speed, less than nominal speed, the displacement sensor 15 controls, via the treatment cell 16, the drive of the motor 12 at a speed approximately equal to the nominal speed for a length of time to cause the article having driven the belt, to slide normally again on the wall.

Figure 3:
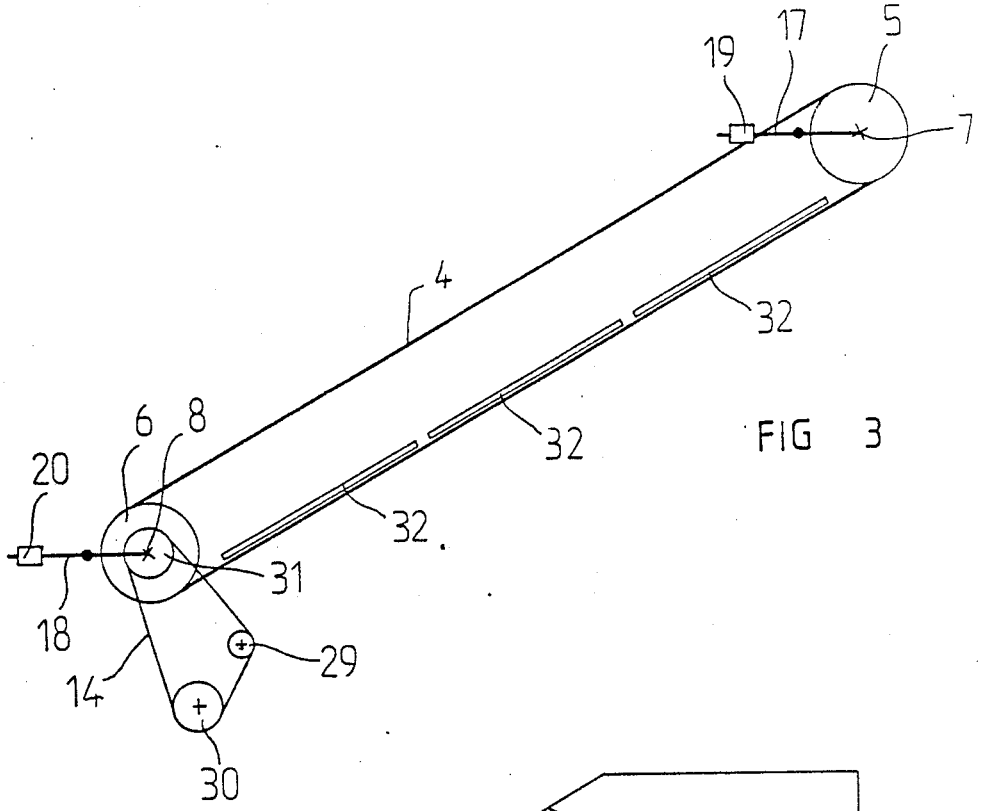
FIG. 3 schematically shows the endless belt equipped with the system for adjusting spacing.

A variant embodiment illustrated in FIG. 3 solves the problem of the variations in thickness of the folds of the article either of the same article during treatment as a function for example of the state of dryness of the material, or for the treatment of different articles on the same installation. Each of the shafts 7–8 of the rollers 5–6 supporting the endless belt 4 according to the invention is mounted on a respective lever arm 17–18 including a counterweight 19–20. In this way, the assembly constituted by the belt 4, the supporting rollers 5–6 and their direct driving means (shafts and free wheel) is balanced thanks to the effect of the counterweights 19 and 20, the latter being adjustable in displacement along the lever arm 17–18. This particular embodiment presents several advantages. Firstly, it enables momentary variations in thickness of the folds formed by the article in the course of treatment to be damped. Furthermore, by displacing the counterweight 19–20 along the lever arm 17–18, it possible to vary both the spacing between the belt 4 and the wall 3, and the forces of friction between the belt 4 and the article 1. The chain 14 is provided with a tensioner 29 enabling the variations in distance between the driving wheel 30 and receiving wheel 31 to be absorbed. The flatness of the endless belt 4 and the regularity of its application on the article 1 may be ensured by plates 32 or any other means.

Figure 4:
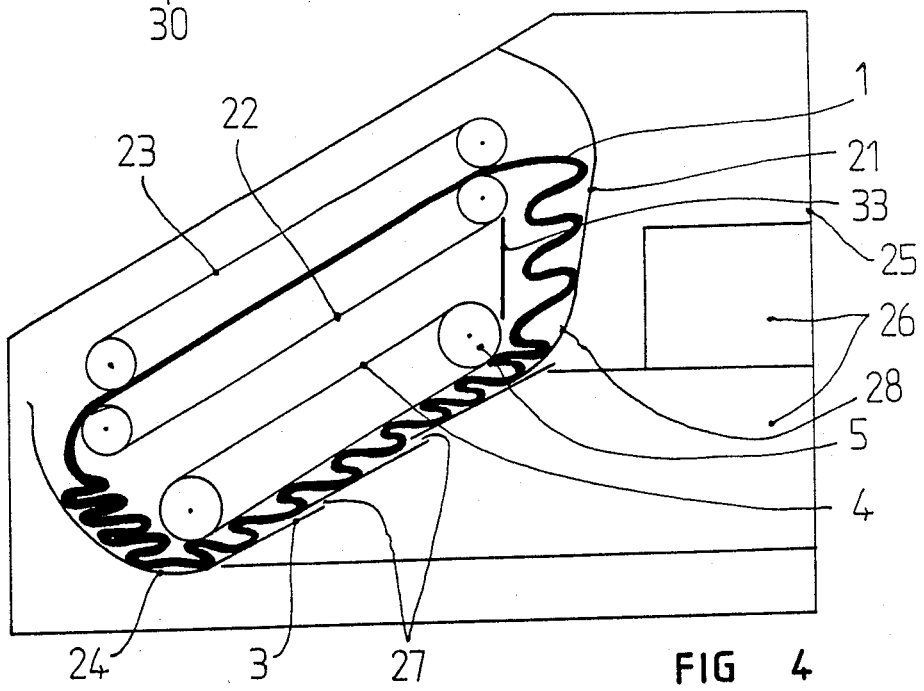
FIG. 4 is a longitudinal section through an installation for relaxing knitted fabric in loop form employing an endless belt according to the invention.

The installation illustrated in FIG. 4 is an apparatus for relaxing articles of knitted fabric, operating in accordance with the process described in European Patent Application No. 82.402013.5 of Nov. 2, 1982. The process and the device according to the present invention are particularly well adapted to such an installation. The knitted article 1 is in the form of a closed loop. While it is still in the damp state, it is projected against the rigid element 21 after having been driven at high speed by the assembly formed by the two belts 22 and 23 between which it is maintained flat. The guide 33, placed opposite the rigid element 21 and positioned between the lower side of the projector belt 22 and the upper side of the supporting belt 4, forms with the rigid element 21 a shaft in which the knitted article 1 drops once it has been projected against the rigid element 21. The knitted article 4 then accumulates without tension in the form of folds and slides along the inclined wall 3 under the effect of its own weight. The wall 3 terminates at a bottom point 24 where the knitted article accumulates before being taken up again by the two projector belts 22 and 23. The relaxation chamber 25 includes hot air creating means, for example an exchanger-ventilator assembly 26. The hot air is directed onto the article 4 in the course of treatment via slots 27 made in the inclined wall 3; this arrangement allows an intimate contact between the hot air and the article while it is without tension. The inclined wall 3 has an angle of inclination of 30° with respect to the horizontal. The outer surface of the endless belt 4 according to the invention is parallel to the wall 3 over that portion where it is in contact with the article. The spacing between the outer surface of the belt and the wall 4 may be between 5 and 30 centimeters. For an article consisting of a polyamide/cotton plush loop of 270 grams per square meter, the optimum spacing in the course of treatment is 15 to 20 centimeters; for a polyamide/cotton duffel of 320 grams per square meter, it is 18 to 22 centimeters. In the course of treatment, this spacing is automatically adjusted when the belt is mounted on lever arm. To improve the action of the hot air, the endless belt 4 is made of an air-permeable material withstanding the temperature at which the treatment is carried out. To facilitate depositing of the article in folds, the roller 5 supporting the belt 4 closest to the projection of the article against the rigid element 28, constitutes the mobile wall of a shaft in which the knitted article drops, and of which the other wall is constituted by an incurved surface 28 connecting the rigid element 28 and the inclined wall 3. The examples given hereinabove are given only by way of illustration. It is possible, while remaining within the scope of the invention, to envisage that the inclined wall over which the textile article slides under the effect of its own weight presents a certain radius of curvature over all or part of its length. In that case, the supporting belt is no longer supported by two rollers only, but by supporting means in a sufficient number for the outer surface of the belt to follow as closely as possible the curvature of the wall and for the spacing to be as constant as possible.

Although it is admitted that the process and the device according to the invention are particularly advantageous in a gaseous medium, the invention is not limited to applications in this medium alone. Furthermore, certain terms used in the present specification are to be interpreted in their broadest meaning: the term "textile article" designates any textile material (knitted article, woven fabric, yarns, . . . ) whatever the presentation thereof (pieces in loop form, discontinuous pieces, finished or semi-finished articles, . . . ); the term "treatment" also includes handlings during which the articles do not undergo particular transformations, simply the displacement over the inclined surface.

What is claimed is:

1. In a device for treating a textile article, said device including a stationary inclined receiving surface having an upper end and a lower end, means for depositing said article onto said upper end in such a way that such article forms folds having a lower part engaging said surface and upper parts projecting away from said surface and such that said folds slide downwardly along said surface under the effect of gravity, and means for drawing off said article from said lower end, the improvement comprising:

an endless belt having an upper section and a lower section;

driving means for driving the belt with said upper section moving upwards and said lower section moving downwards, said lower section being disposed over at least a portion of said surface in substantially parallel relationship with said portion of said surface and at such a distance therefrom as to allow said lower surface of said belt to engage said upper parts of said folds; and a plurality of rollers which support said belt, one of said rollers being a driving roller, and wherein said driving means comprises a shaft coupled to one of said rollers and motor means for driving a free-wheel coupled to said shaft at a speed which is slightly less than the speed of said shaft when said material is sliding down said surface at its nominal speed under the influence of gravity alone and said material is moving said belt at said nominal speed due to the frictional contact between said article and said belt.

2. In a device for treating a textile article, said device including a stationary inclined receiving surface having an upper end and a lower end, means for depositing said article onto said upper end in such a way that such article forms folds having a lower part engaging said surface and upper parts projecting away from said surface and such that said folds slide downwardly along said surface under the effect of gravity, and means for drawing off said article from said lower end, the improvement comprising:

an endless belt having an upper section and a lower section;

driving means for driving the belt with said upper section moving upwards and said lower section moving downwards, said lower section being disposed over at least a portion of said surface in substantially parallel relationship with said portion of said surface and at such a distance therefrom as to allow said lower surface of said belt to engage said upper parts of said folds; and a plurality of rollers supporting said belt, one of said rollers being a driving roller, and wherein said driving means comprises a variable speed motor and a sensor for sensing the speed of said belt, and wherein said driving means comprises a variable speed motor and a sensor for sensing the speed of said belt, said motor and said sensor cooperating in such a manner that when the speed of said article, and therefore the speed of said belt, falls substantially below a predetermined speed, said motor causes said belt to momentarily speed up for a sufficient length of time to permit said article to resume said predetermined speed.

3. In a device for treating a textile article, said device including a stationary inclined receiving surface having an upper end and a lower end, means for depositing said article onto said upper end in such a way that such article forms folds having a lower part engaging said surface and upper parts projecting away from said surface and such that said folds slide downwardly along said surface under the effect of gravity, and means for drawing off said article from said lower end, the improvement comprising:

an endless belt having an upper section and a lower section;

driving means for driving the belt with said upper section moving upwards and said lower section moving downwards, said lower section being disposed over at least a portion of said surface in substantially parallel relationship with said portion of said surface and at such a distance therefrom as to allow said lower surface of said belt to engage said upper parts of said folds; and first and second rollers on which said belt is supported, each of said rollers being supported by a respective lever arm which is coupled to a respective counterweight, said lever arms and said counterweights cooperating to adjust the distance between said lower section of said belt and said surface as a function of the thickness of said folds.

4. Apparatus comprising:

(a) a stationary, planar inclined receiving surface having an upper and a lower end;

(b) means for depositing a textile article onto said upper end of said surface in such a manner that:

(1) said article forms folds having a lower part engaging said surface and upper parts projecting away from said surface; and (2) said folds slide down said surface under the effect of gravity;

(c) a belt moving along a plane which is spaced from and parallel to said planar surface and substantially coextensive therewith, the spacing between said belt and said planar surface being such that said belt will be in contact with said upper part of said material when said material is located on said surface;

(d) means for driving said belt such that it moves past said planar surface in a downward direction; and (e) a plurality of rollers which support said belt, one of said rollers being a driving roller, and wherein said driving means comprises a shaft coupled to one of said rollers and motor means for driving a free-wheel coupled to said shaft at a speed which is slightly less than the speed of said shaft when said material is sliding down said surface at its nominal speed under the influence of gravity alone and said material is moving said belt at said nominal speed due to the frictional contact between said article and said belt.

5. Apparatus comprising:

(a) a stationary, planar inclined receiving surface having an upper and a lower end;

(b) means for depositing a textile article onto said upper end of said surface in such a manner that:

(1) said article forms folds having a lower part engaging said surface and upper parts projecting away from said surface; and (2) said folds slide down said surface under the effect of gravity;

(c) a belt moving along a plane which is spaced from and parallel to said planar surface and substantially coextensive therewith, the spacing between said belt and said planar surface being such that said belt will be in contact with said upper part of said material when said material is located on said surface;

(d) means for driving said belt such that it moves past said planar surface in a downward direction; and (e) a plurality of rollers supporting said belt, one of said rollers being a driving roller, and wherein said driving means comprises a variable speed motor and a sensor for sensing the speed of said belt, said motor and said sensor cooperating in such a manner that when the speed of said article, and therefore the speed of said belt, falls substantially below a predetermined speed, said motor causes said belt to momentarily speed up for a sufficient length of time to permit said article to resume said predetermined speed.

6. Apparatus comprising:

(a) a stationary, planar inclined receiving surface having an upper and a lower end;

(b) means for depositing a textile article onto said upper end of said surface in such a manner that:

(1) said article forms folds having a lower part engaging said surface and upper parts projecting away from said surface; and (2) said folds slide down said surface under the effect of gravity;

(c) a belt moving along a plane which is spaced from and parallel to said planar surface and substantially coextensive therewith, the spacing between said belt and said planar surface being such that said belt will be in contact with said upper part of said material when said material is located on said surface;

(d) means for driving said belt such that it moves past said planar surface in a downward direction; and (e) first and second rollers on which said belt is supported, each of said rollers being supported by a respective lever arm which is coupled to a respective counterweight, said lever arms and said counterweights cooperating to adjust the distance between said lower section of said belt and said surface as a function of the thickness of said folds.

7. A device for treating a textile article, comprising:

a fixed, inclined sliding surface along which the textile article accumulates in folds and moves under the effect of its own weight along said sliding surface;

an endless belt supported by a plurality of rollers, a portion of said belt being in contact with upper parts of said folds of said article so that said article tends to move said belt in the sliding direction of said article as a result of the frictional contact between said article and said belt;

means for insuring that the speed of displacement of said belt is never substantially less than the normal speed of said article when said article moves along said sliding surface under the effect of its own weight, said driving means including a shaft coupled to one of said rollers and motor means for driving a free-wheel coupled to said shaft at a speed which is slightly less than the speed of said shaft when said material is sliding down said surface at its normal speed under the influence of gravity alone and said material is moving said belt at said normal speed due to the frictional contact between said article and said belt.

8. A device for treating a textile article comprising:

a fixed, inclined sliding surface along which the textile article accumulates in folds and moves under the effect of its own weight along said sliding surface;

an endless belt supported by a plurality of rollers, a portion of said belt being in contact with upper parts of said folds of said article so that said article tends to move said belt in a sliding direction of said article as a result of the frictional contact between said article and said belt;

means for insuring that the speed of displacement of said belt is never substantially less than the normal speed of said article when said article moves along said sliding surface under the effect of its own weight, said driving means including a variable speed motor and a sensor for sensing the speed of said belt, said motor and said sensor cooperating in such a manner that when the speed of said article, and therefore the speed of said belt, falls substantially below a predetermined speed, said motor causes said belt to momentarily speed up for a sufficient length of time to permit said article to resume said predetermined speed.

9. A device for treating a textile article, comprising:

a fixed inclined sliding surface along which the textile article accumulates in folds and moves under the effect of its own weight along said sliding surface;

an endless belt supported by a plurality of rollers, a portion of said belt being in contact with upper parts of said folds of said article so that said article tends to move said belt in the sliding direction of said article as a result of the frictional contact between said article and said belt;

each of said rollers being supported by a respective lever arm which is coupled to a respective counterweight, said lever arms and said counterweights cooperating to adjust the distance between said belt and said surface as a function of the thickness of said folds.

* * * * *